United States Patent [19]

Ando et al.

[11] 4,143,965

[45] Mar. 13, 1979

[54] ELECTROPHOTOGRAPHY METHOD UTILIZING A PHOTOCONDUCTIVE SCREEN

[75] Inventors: Yujiro Ando, Yokohama; Shunichi Ishihara, Kodaira; Shuji Murakawa, Yokohama; Katsunobu Ohara, Kawasaki, all of Japan

[73] Assignee: Canon Kabushiki Kaisha, Tokyo, Japan

[21] Appl. No.: 825,481

[22] Filed: Aug. 17, 1977

Related U.S. Application Data

[63] Continuation of Ser. No. 568,465, Apr. 16, 1975, abandoned.

[51] Int. Cl.[2] ..... G03G 15/18

[52] U.S. Cl. ..... 355/35 C

[58] Field of Search ..... 96/1 R; 355/35 C, 3 DR, 355/3 CH; 250/324, 325, 326; 361/230, 229

[56] References Cited

U.S. PATENT DOCUMENTS

| | | | |
|---|---|---|---|
| 3,483,372 | 12/1969 | Benson | 361/230 X |
| 3,611,414 | 10/1971 | Frank | 250/324 X |
| 3,773,417 | 11/1973 | Pressman et al. | 96/1 R X |
| 3,880,513 | 4/1975 | Fottand | 355/35 C |
| 3,898,085 | 8/1975 | Suzuki et al. | 355/35 C X |

*Primary Examiner*—Michael L. Gellner

*Attorney, Agent, or Firm*—Fitzpatrick, Cella, Harper & Scinto

[57] ABSTRACT

In an electrophotographic method wherein a photosensitive screen having a multitude of tiny openings and formed by the use of a photoconductive member is used to form a primary electrostatic latent image thereon and a corona ion flow from a corona discharger is modulated by the primary electrostatic latent image to form a secondary electrostatic latent image on an electrically chargeable member, an acceleration field having a voltage Ve applied between the screen and the chargeable member is set to a range which satisfies the relation that $(Ve-Vs)/d > 500[V/mm]$, where d is the distance between the screen and the chargeable member, and Vs is the maximum potential of the secondary electrostatic latent image formed on the chargeable member.

14 Claims, 12 Drawing Figures

ELECTROPHOTOGRAPHY METHOD UTILIZING A PHOTOCONDUCTIVE SCREEN

This is a continuation, of application Ser. No. 568,465, filed Apr. 16, 1975, now abandoned.

BACKGROUND OF THE INVENTION

1. Field of the Invention

This invention relates to electrophotography, and more particularly to the technique of forming a latent image on a recording member by the use of a photosensitive screen having a multitude of tiny openings.

2. Description of the Prior Art

As the typical conventional electrophotography, there have been proposed a direct process such as, for example, electrofax, and an indirect process such as xerography. In the direct electrophotographic process, use is made of a specially treated image recording member coated with a photoconductive material such as zinc oxide. The direct method, however, has a drawback in that as the image formed on the recording member lacks in brightness, contrasts in the tones of the reproduced image are poor. Moreover, owing to a particular treatment rendered on the recording member, it is heavier than the conventional paper, hence a particular feeding means which is different from that for ordinary paper should be employed. According to the indirect process, an image of high contrast and good quality can be obtained by using ordinary paper as the image recording member. However, in the direct process, when a toner image is transferred to the recording member, the latter inevitably contacts the surface of the photosensitive member and further, cleaning means vigorously touches the surface of the photosensitive member for removal of the residual toner thereon with the consequence that the photosensitive member is impaired every time the transfer and cleaning operations are carried out. As the result of this, life of the expensive photosensitive member becomes shortened, which unavoidably means high cost in the image reproduction.

Therefore, in order to eliminate such drawbacks inherent in the conventional electrophotographic processes, there have been contemplated various methods such as, for example, those taught in the U.S. Pat. No 3,220,324, No. 3,645,614, No. 3,647,291, No. 3,680,954, and No. 3,713,734. In these patents, there is used a photosensitive member of screen type or grid type having a number of openings in the form of fine net. The electrostatic latent image is formed on the recording member by modulating flow path of ions through the screen or grid, after which the latent image formed on the recording material is visualized. In this case, the screen or grid which corresponds to the photosensitive member need be neither developed nor cleaned, hence the life of the screen or grid can be prolonged.

U.S. Pat. No. 3,220,324 teaches use of a conductive screen coated with a photoconductive material, through which an image exposure is effected onto the recording member simultaneously with the corona discharge. The flow of corona ions produced as the consequence of the corona discharge is modulated by the screen, whereby an electrostatic latent image is formed on the recording member. U.S. Pat. No. 3,680,954 teaches use of a conductive grid coated with a photoconductive material, and a conductive control grid, in which an electrostatic latent image is formed on the conductive grid, and different electric fields are formed between the conductive grid and control grid so as to modulate flow of the corona ions for forming an image on the recording member. In U.S. Pat. No. 3,645,614, the screen comprises an insulating material overlaid with a conductive material, and the insulating material comprises a photoconductive material. An electric field to prevent the ion flow from passing through the screen is formed at the openings or perforations for permitting the ion flow to pass therethrough owing to the electrostatic latent image formed on the screen. U.S. Pat. No. 3,713,734 teaches use of a four-layer screen consisting of a photoconductive substance, a first conductive substance, an insulating substance, and a second conductive substance, in which an electrostatic latent image is formed on the photoconductive substance in conformity to the original picture image by the processes of electric charging and image exposure. Also, in the case of forming an image on the recording member by modulating the flow of the corona ions through the electrostatic latent image, the second conductive substance of the screen is imparted a voltage having a polarity opposite to that of the electrostatic latent image on the screen, since the image is in a single polarity. U.S. Pat. No. 3,647,291 teaches the formation of an electrostatic latent images of mutually different polarities on a two-layer screen consisting of a conductive substance and a photoconductive substance in correspondence to a bright image portion and a dark image portion so as to modulate passage of the corona ion flow by the latent image formed on the screen.

As described, the screen is capable of forming an electrostatic latent image on a recording member without the latter being contacted by the former, and greatly differs from the conventional electrophotographic process using the TESI method. In the electrophotography using the screen, however, there is a tolerance for the distance defined between the screen and the recording member if such tolerance is exceeded, the latent image on the recording member would be blurred or unnaturally thick with a result that a visible image faithful to the original image could not be provided. Further, the method whereby ion flow is modulated by an electrostatic latent image preformed on the screen is not preferable in that the latent image on the screen may happen to be erased. On the other hand, there is also a tolerance for the intensity of the field acting between the screen and the recording member during modulation of ion flow and whenever such tolerance is exceeded, there will be obtained no good result.

SUMMARY OF THE INVENTION

It is a primary object of the present invention to effect ion modulation by means of a screen to thereby form an electrostatic latent image faithful to an original image on a chargeable member.

It is another object of the present invention to increase the speed of the ion modulation.

It is still another object of the present invention to increase the frequency of ion modulation and accordingly the speed of image formation in the electrophotographic method wherein ion modulation may be done a plurality of times by a single latent image formed on a screen.

It is also an object of the present invention to produce copy images faithful to an original image at high speed.

Other objects and effects will appear as the description progresses hereinafter.

The present invention which will achieve the above objects finds out a predetermined correlation in the optimum conditions for the formation of secondary electrostatic latent image and numerically determines such optimum conditions. More specifically, it determines the value of Ve which will satisfy the relation that $(Ve-Vs)/d>500$[V/mm], where Ve is an acceleration field applied between the screen and the recording member, *d* is the distance between the screen and the recording member, and Vs is a maximum potential of the secondary electrostatic latent image formed on the recording member. Especially, in case where the screen describes an arc in the secondary electrostatic latent image forming position, the width of the corona discharger providing a source of corona ions is controlled to its tolerance in accordance with the distance between the screen and the recording member. Although such control is variable with the desired degree of perfection of the resultant copy image, the width of the corona discharger may be as follows: The width of the corona discharge used for ion modulation is determined within a range which will satisfy the relation that $Ve/d>500$[V/mm] on that side of the screen which initially receives the corona discharge (hereinafter referred to as "the entrance portion") and the relation that $(Ve-Vs)/d>500$[V/mm] on the other side of the screen on which the corona discharge is terminated (hereinafter referred to as "the exit portion"). The method of controlling the width of the corona discharge may be carried out either by using a corona discharger and applying a voltage to a shield member forming such corona discharger or by providing corona ion flow control means in the opening portion of the shield member which is adjacent the screen.

The term "screen" used herein refers to a combination of a photoconductive member and an electrically conductive member and further, sometimes an insulating member, formed with a multitude of tiny openings or slits. Also, the primary electrostatic latent image means a latent image formed on the screen through the processes of charging, image projection, etc. and the secondary electrostatic latent image refers to a latent image formed on a chargeable member by using the primary electrostatic latent image to modulate ion flow. Further, retention modulation means ion modulation carried out multiple times by the use of the single primary electrostatic latent image, and retention copy refers to the production of a copy image through the retention modulation.

The invention will become more fully apparent from the following detailed description taken in conjunction with the accompanying drawings.

DESCRIPTION OF THE PREFERRED EMBODIMENTS

Details of the present invention will specifically be described hereinafter by reference to the drawings. An illustrative form of the screen used in a specific embodiment to be described herein will first be explained by reference to the enlarged cross-sectional view of FIG. 1, and an example of the latent image formation process using the FIG. 1 screen will be explained by reference to FIGS. 2 to 5. The screen shown in FIG 1 is of the type in which ion modulation is carried out after formation of a primary electrostatic latent image, but the present invention is not restricted to such screen but is equally applicable to any other type of screen than that described herein.

Figure 1:
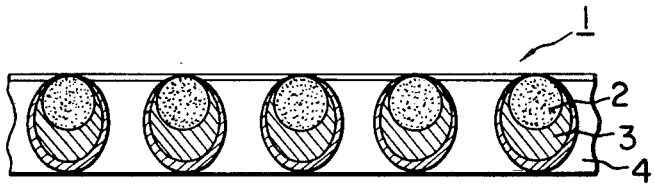
FIG. 1 is an enlarged cross-sectional view for illustrating an illustrative form of the screen to which the present invention is applicable.
Figure 2:
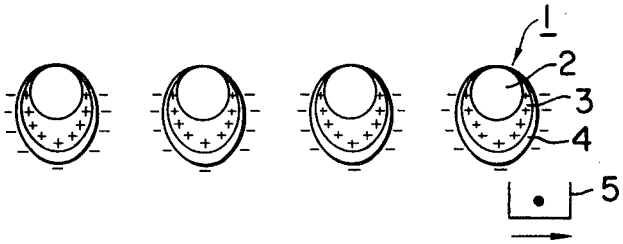
FIG. 2 to 4 illustrate the step of forming a primary electrostatic latent image by the screen shown in FIG. 1.

The photosensitive screen shown in FIG. 1 is so constructed that a photoconductive member 3 and an insulative member 4 are applied as laminar coating on an electrically conductive member 2 having a multitude of tiny openings. The coating is done in such a manner that the electrically conductive member 2 may be exposed in part.

The abovementioned conductive member 2 is manufactured by etching a plate of metal such as stainless steel, nickel or the like to form therein a multitude of tiny openings, or by electroplating such conductive material on a wire net to serve as the screen, or by weaving wire of such conductive material in the form of net. The mesh size of the conductive member 2 may range from 100 to 400 meshes (100 to 400 openings per linear inch) from the standpoint of resolution of the original image for reproduction.

The layer of photoconductive member 3 is provided on the conductive member formed in the manner as described above. Formation of the photoconductive layer 3 may be done by evaporating a photoconductive substance such as Se-alloy or the like or by spraying a dispersion of insulative resin containing particles of photoconductive substance such as CdS, PbO or the like. The thickness of the photoconductive member 3 is variable in dependence of the substance used and the characteristic desired, but usually 10 to 80 microns is most suitable for the thickest portion.

Further, the insulative member 4 to be provided on the photoconductive member 3 may be formed in the same manner as the photoconductive member, by vacuum-evaporating a transparent insulative substance or by spraying synthetic resin or other organic substance of high resistance. The thickness of the insulative member 4 is determined in connection with the thickness of the photoconductive member 3. The insulative substance may be epoxy resin, acrylic resin, silicone resin or the like. Thus, the photoconductive member 3 and the insulating member 4 are formed in such a manner that they thickly cover one side of the conductive member 1 while the other side of the conductive member 1 is exposed. Whenever the photoconductive substance and/or the insulative substance also adheres to the other side of the conductive member 1, such adhering substance may be removed as by grinding.

The electrostatic latent image forming process using the above mentioned photosensitive screen shown in FIG. 1 will now be explained with reference to FIG. 2 to 5. Throughout the ensuing explanations, the screen used has such characteristic that the positive hole is injected into the photoconductive member even at the dark place. In the drawing, the photoconductive member 3 is made of a semiconductor consisting of selenium and its alloys with the hole as the principal carrier.

Figure 3:
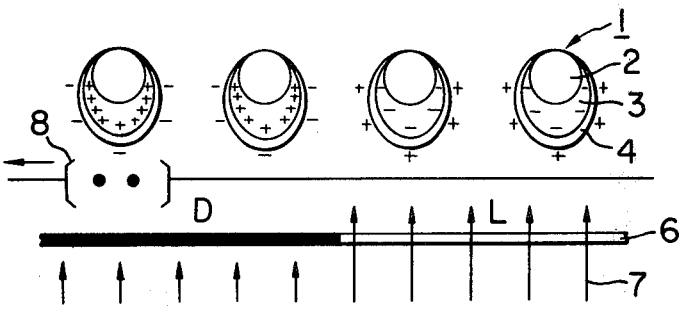

FIG. 3 indicates the results of the primary voltage application having been carried out, wherein the insulative member 4 is uniformly charged with the negative polarity by an electric charging means such as corona discharger or the like. By this electric charging, the hole is injected into the interior of the photoconductive member 3 through the conductive member 2, and is captured at the interface in the vicinity of the insulative member 4. The reference numeral 5 in FIG. 2 designates the corona discharger.

FIG. 3 indicates the result of the secondary voltage application and the image irradiation processes having been carried out simultaneously. For the secondary voltage application, use is made of the corona discharge with a voltage comprising a bias voltage of the positive polarity superposed on an AC voltage as the power source. By these two processes simultaneously carried out, the surface potential of the insulative member 4 turns to the positive, although there still exists the negative potential on the surface part of the insulative member corresponding to the dark portion of the original image in contrast to the bright portion at the irradiated part thereof. This is due to existence of the positive electric charge in the vicinity of the insulative member 4 in the photoconductive member 3. The voltage for use in the secondary voltage application, besides the above-mentioned AC voltage, may also be a DC voltage having an opposite polarity to that used in the primary voltage application. Further, in case the dark attenuation characteristic of the photoconductive member is slow, the voltage application and the image irradiation processes can be carried out sequentially, not simultaneously as mentioned above. In this drawing, the reference numeral 6 designates an original image, wherein L is the bright portion and D is the dark portion of the image pattern; 7 designates light beam and 8 represents the corona discharger. By these secondary voltage application and the image irradiation processes, an electrostatic latent image is formed on the screen 1, and the thus formed latent image increases its electrostatic contrast with lapse of time, or by the overall surface irradiation, whereby the primary electrostatic latent image is completed.

Figure 4:
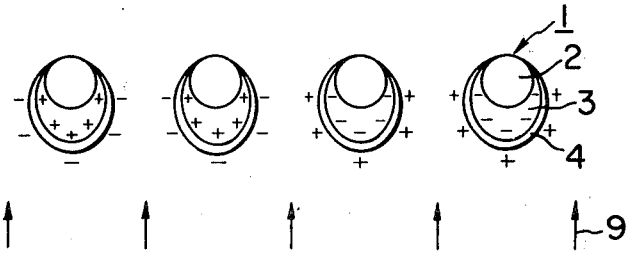

FIG. 4 represents the results of the overall surface irradiation having been done on the above-mentioned screen 1. While no change takes place in the surface potential of the screen 1 at its bright portion by this overall surface irradiation process, the surface potential at the dark portion thereof rapidly changes to an electric potential which is proportionate to the amount of the surface charge on the insulative member 4, whereby the primary electrostatic latent image is formed. The reference numeral 9 in this drawing denotes light beam.

Figure 5:
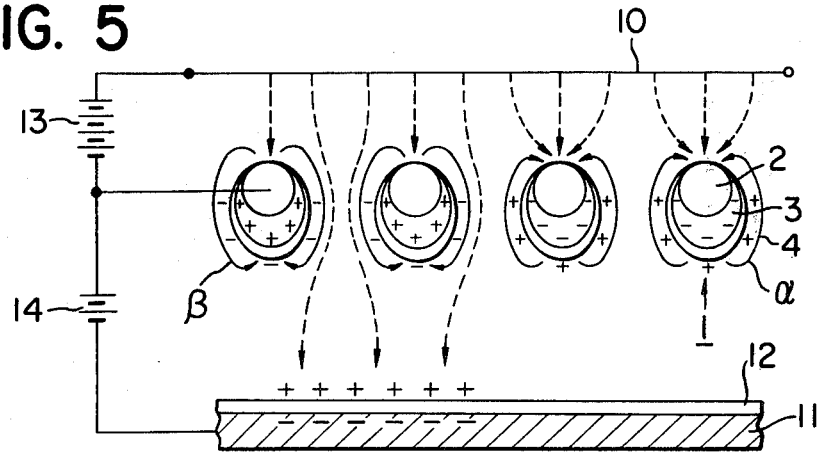
FIG. 5 illustrates the step of forming a secondary electrostatic latent image through modulation of ion flow by the primary electrostatic latent image on the screen.

FIG. 5 shows a state wherein ion current is modulated by the primary electrostatic latent image on the screen 1 so as to form on a recording member a positive image of the original by the modulated electric charge. In this drawing, the reference numeral 10 designates a corona wire of the discharger, 11 an electrode member, 12 a recording member which is capable of maintaining the electric charge, and 13, 14 a power source.

As seen from the drawing, the recording member 12 is disposed in the neighborhood of the insulative member 4 of the screen 1, and the corona wire 10 is disposed at the side where the conductive member 2 of the screen 1 is exposed to the outside, whereby the corona ion current from the corona wire 10 is impressed on this recording member 12 by making use of the potential difference between the corona wire 10 and the electrode member 11. At this time, there is created an electric field as shown by the solid line $\alpha$ at the bright portion of the screen 1 by the electric charge to form the primary electrostatic latent image. By the thus formed electric field, the ion current shown by the dotted line is prevented from passing through the screen, and is caused to flow into the conductive member 2 from the exposed portion thereof. In contrast to this, there is created an electric field shown by the solid line $\beta$ at the dark portion of the screen 1, and the ion current, in spite of its being of an opposite polarity to that of the primary electrostatic latent image, reaches the recording member 12 without obliterating the formed electrostatic latent image. Moreover, as the primary electrostatic latent image is formed on the insulative member 4 as mentioned above, it is possible to raise the electrostatic contrast due to the amount of electric charge to a very high level. It is also possible that attenuation of the formed electric charge can be reduced as little as possible, hence repeated formation of the secondary electrostatic latent image can be done by a single primary electrostatic latent image, whereby the so-called retention copying wherein multiple reproduction copies of the original image can be made from one and the same primary electrostatic latent image becomes possible.

Figure 6:
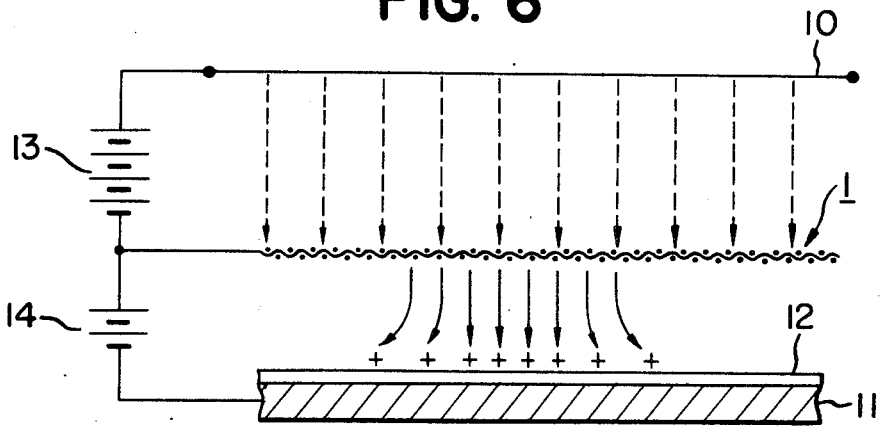
FIG. 6 illustrates the thickening of latent image which tends to occur during formation of the secondary electrostatic latent image.

The inventor has discovered that during the ion modulation described in connection with FIG. 5, there are close correlations between the screen 1 and the recording member 12 and the intensity of the acceleration field therebetween resulting from the corona source 10 and the intensity of the discharge from the corona wire 10. According to the discovery, when, for example, retention copying is effected by the use of the above-described screen, a weak intensity of acceleration field will result in formation of blurred secondary electrostatic latent image and will further prevent the corona ion from the wire 10 from electrically neutralizing the primary electrostatic latent image on the screen 1, as a result of which the primary latent image will be attenuated to reduce the performance of retention modulation. Particularly, when it is desired to form the primary electrostatic latent image with a high potential and provide good color harmony and accordingly sufficient representation of halftone as well as high image resolution, there will be required a sufficiently great acceleration field. Also, even in case where the corona discharger used for the formation of secondary electrostatic latent image is of such a great capacity as will produce an intense corona ion flow, there will be required an acceleration field for sufficiently attracting the corona ion flow toward the recording member. Further, when the secondary electrostatic latent image on the recording member is formed with a high potential, the vertical field between the screen and the recording member will be bent by the electric charges being already formed. The result is that, as shown in FIG. 6, the formed secondary electrostatic latent image will be unnecessarily thicker than the primary electrostatic latent image or the outline of the secondary latent image will be blurred. FIG. 6 corresponds to the secondary latent image forming step of FIG. 5 and the arrows therein indicate the corona ion flow which passes to the recording member as it is bent after modulation by the reason set forth above. To prevent the above-described thickening of the secondary latent image, the acceleration field must be properly set in accordance with the desired potential of the secondary electrostatic latent image: for example, when the secondary latent image is to be formed with a high potential, the acceleration field must be of high intensity and the distance between the screen and the recording member must be set to a proper value. Specifically, if the potential in the dark portion of the secondary latent image on the screen is 200 V, the acceleration field may preferably be 500 V/mm or higher and, when the screen 1 of the above-described type is used, retention modulation may easily be carried out as frequently as one hundred times or more if the acceleration field is 1 KV/mm or higher.

Now, when the distance between the screen 1 and the recording member 12 is set to 3 mm and the acceleration field of 1 KV/mm is used, even a secondary latent image of the order of 500 V formed on the recording member will encounter no such thickening that will offer inconveniences in practice. However, if the secondary latent image is of the order of 1 KV, thickening of the latent image will extend to 0.2 mm or more around the periphery thereof and this will offer inconveniences to its observation by naked eye. Solution to this problem may be accomplished either by reducing the distance between the screen 1 and the recording member 12 or by increasing the intensity of the acceleration field.

Figure 7:
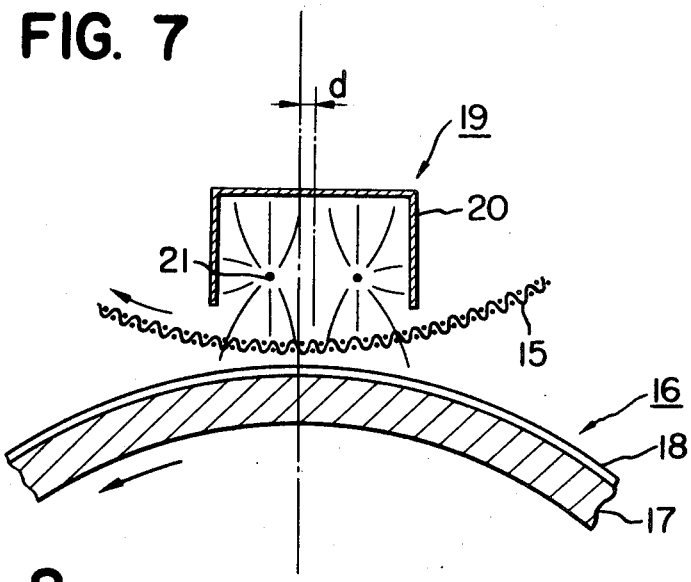
FIG. 7 is a cross-sectional view showing part of the secondary electrostatic latent image forming portion in the image forming apparatus.

When image formation is actually to be done by the use of a screen, the screen and the recording member in the apparatus during ion modulation may be arranged either flatly or arcuately with respect to each other. In the latter case, as shown in FIG. 7, the distance defined between the screen 15 and the recording member as they are rotating in the directions of respective arrows will be varied continuously. FIG. 7 shows the secondary electrostatic latent image forming portion of the image forming apparatus, wherein the screen 15 is configured like an endless cylindrical form and the recording member 16 is cylindrically shaped. The recording member 16 comprises an electrically conductive backup member 17 which is an electrode, and an insulative surface layer 18. Designated by 19 is a corona discharger which is a source of ion flow for modulation. Numeral 20 designates a shield plate and 21 corona wires. When a secondary electrostatic latent image is to be formed by the use of the above-described configuration, the limitation in the distance between the screen and the recording member also imposes a limitation upon the width of the discharger 19 with respect to the direction of rotation. If, for example, the potential difference between the screen 15 and the recording member 16 is 4 KV, the width of the corona dicharger must be set within such a rande that the distance betweem the screen 15 and the recording member 16 is within 8 mm (preferably within 4 mm). Such distance, of course, depends on the potential of the secondary latent image formed on the recording member 16: for example, if the insulative layer 18 is thin or of high dielectric constant and if the secondary latent image to be formed may be of low potential, say, of the order of 200 V by selecting a developing condition suitable for latent image of low potential, then a wide range of 6 mm or more will be allowed as said distance. Thus, (V3-Vs)/d must be 500 [V/mm] or more, where *d* is the distance between the screen and the recording member, Ve the acceleration field applied therebetween and Vs the maximum potential of the secondary electrostatic latent image formed on the recording member. If (Ve-(Ve-exceeds 800 [V/mm], a better secondary electrostatic latent image may be formed. The upper limit of the value may be increased to such an extent that no dielectric breakdown (spark discharge) occurs between the screen and the recording member. Such dielectric breakdown is liable to occur in an atmosphere containing dust and dirt when the distance between the electrodes exceeds about 2000 V per millimeter.

The tolerance for the distance between the screen and the recording member will further be described. In the arrangement as shown in FIG. 7, when the screen 15 passes by the corona discharger 19 in modulating position, the above-described thickening of latent image is not liable to occur on that side of the screen which initially receives corona discharge because the potential of the secondary latent image is not yet raised on the recording member 16, and thus said distance may be set to a wide tolerance. However, at a point of time when the screen leaves the corona dicharger 19, the potential of the secondary latent image is already so high that thickening of the latent image is liable to occur and therefore, the tolerance for said distance becomes narrower. For this reason, the discharger 19 may preferably be located in such a manner that the center line of the discharger 19 is deviated or inclined by a distance *d* in the direction opposite to the direction of rotation of the screen 15 with respect to the line passing through the axes of rotation of the screen and the recording member. However, the present invention is not confined to the case where the discharger is deviated or inclined, as shown in FIG. 7, but covers the case where the center line of the discharger 19 is located on a radius of the screen 15. By doing so, the distance between the screen and the recording member may be greater at the entrance portion of the corona discharger for the screen and smaller at the exit portion thereof. Such arrangement, as compared with an arrangement in which the center line of the corona discharger is coincident with the line passing through said axes of rotation, permits the use of a wider corona discharger and accordingly, sufficient application of corona ion flow, which is turn leads to a result that secondary electrostatic image formation is feasible even if the screen is rotated at high speed.

Figure 8:
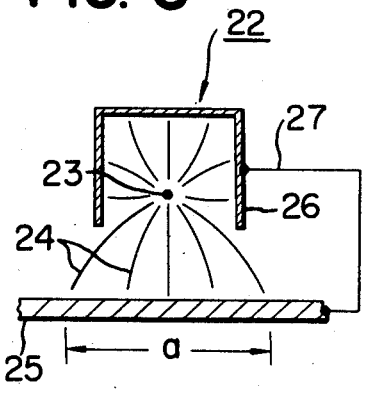
FIG. 8 schematically illustrates an example of the conventional corona discharger.
Figure 9:
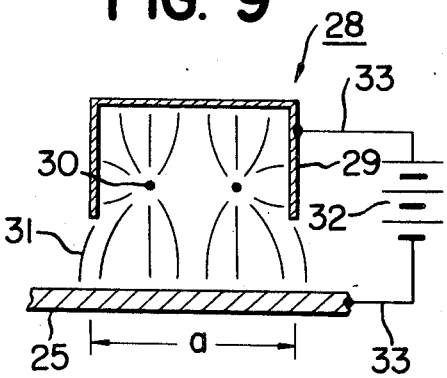
FIGS. 9 and 11 schematically illustrate some embodiments of the corona discharger effective for use with the present invention.
Figure 10:
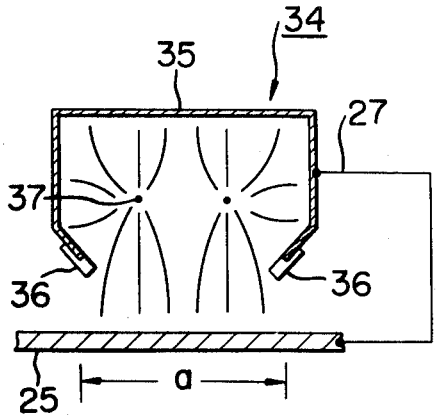
Figure 11:
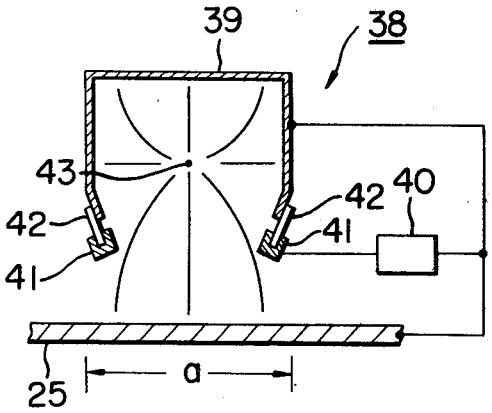

The advantages resulting from the application of the screen type electrophotography to a copy apparatus have been noted above, but with a screen capable of retention copying, a further great advantage will be provided by availing of its characteristic. More particularly, during retention copying, the primary electrostatic latent image forming means such as optical system, charger, etc. need not be operated with respect to the screen and correspondingly, the screen may be rotated at high speed to effect secondary electrostatic latent image formation at high speed, as a result of which copy image may be provided at high speed. To permit retention copying to be thus effected at high speed, the screen may be cylindrically configured and rotated, but in such case the width of the corona discharger for the formation of secondary electrostatic latent image is limited as already noted. Therefore, corona discharge of sufficient intensity over a width within the tolerance must be imparted to the recording member through the screen. Corona dischargers for modulation, especially, those which will be highly effective for application in the high-speed copying apparatus as described, will now be shown by way of example. FIGS. 8 to 11 show, in cross-section, such corona dischargers and opposed electrodes, each of these dischargers having the function of carrying out discharge over the same width *a*. The discharger 22 shown in FIG. 8 is one which has been used in the conventional electrophotographic copying apparatus. With such discharger 22, the ion flow from corona wire 23 follows the field, indiated by solid lines 24, to reach the electrode 25. If an electrically chargeable member is present on the electrode 25, the charges will stick to the chargeable member. In case of such discharger 22, however, the amount of corona discharge is much lower in the opposite end portions of the discharge width than in the center portion, and this discharger will be particularly inefficient if installed in an environment wherein the discharge width is limited. On the other hand, if it is desired to increase the total amount of current flowing to the electrode 25, the corona ion flow in the center portion of the discharge width will be greatly increased and, if the discharger of FIG. 8 is used for retention copying, the intense ion flow in the center portion will negate the primary electrostatic latent image. As the result, the frequency of retention copying will undesirably be reduced. In FIG. 8, numeral 26 denotes an electrically conductive shield plate of brass or like metal, and 27 a connecting line which electrically connects the shield plate 26 to the electrode 25. Some examples of the secondary electrostatic latent image forming corona discharger which overcomes the above-noted disadvantages are shown in FIGS. 9 to 11.

The discharger 28 of FIG. 9 is such that a voltage of the same polarity as that of the voltage applied to corona wires 30 is applied to the shield plate 29. The corona discharge width is limited by the field 31 directed from the shield plate 29 to the opposed electrode 25, and corona discharge may be effected relatively uniformly within the discharge width. Thus, a sufficient amount of discharge may be provided even from a relatively weak discharge. Also, the limited discharge width holds true even when a large-sized discharger is used. For these reasons, the corona discharger 28 is suitable as the corona discharger for the formation of secondary electrostatic latent image. The discharge width may be limited as described, even if the voltage applied to the shield plate 29 is opposite in polarity to the voltage applied to the corona wires 30. In this case, however, there is a disadvantabge that the corona ion is liable to flow into the shield plate 29 to increase unnecessary current. In FIG. 9, numeral 32 designates a voltage source from which a voltage is applied to the shield plate 29, and 33 a connecting line which electrically connects the voltage source 32 to the shield plate 29 annd the electrode 25.

The corona discharger 34 shown in FIG. 10 comprises a shield plate 35 and insulative members 36 provided in the discharging or opening portion of the shield plate. The insulative members 36 may be formed by synthetic resin such as polyethylene terephthalate, polycarbonate, acrylic resin, vinyl chloride or the like, and they may be adhesively or otherwise secured to the opening portion of the shield plate 35. In the corona discharger 34 according to the present embodiment, part of the insulative members 36 is charged by the discharge from corona wires 37 to develop a field, by which the corona discharge width is limited. Thus, the present embodiment achieves the same effect as that achieved by the discharger 28 of FIG. 9. The corona discharger 38 is shown in FIG. 11 is one which, like the above-described discharger 34, has means for limiting the discharge width provided in the opening portion of the shield plate 39. In the present embodiment, a varistor element 40 is employed in lieu of insulative member, and electrodes 41 are connected to the element 40. Numeral 42 designates insulative members provided between the shield plate 39 and the electrodes 41. The corona discharger 38 of the present embodiment is such that the potential of the electrodes 41 is increased by the corona ion from the corona wire 43 to thereby limit the discharge width by the same principle of the discharger 34. Since the potential of the electrodes 41 is maintained at a predetermined level, say 1 KV, by the element 40, a greater stability is provided than in the discharger of FIG. 10 which is provided with the insulative members in the opening portion. Alternatively, the discharge width may be limited simply by electrically floating the electrodes 41, but the shown use of the electrodes 40 to maintain them at a predetermined potential is more effective to prevent contamination of the insulative members 42, whereby dielectric breakdowen and accordingly leak which in turn would result in potential variation may be eliminated to provide for stable operation of the corona discharger. The corona discharger 38 of the present embodiment can also achieve the same effect as that achieved by the above-described discharger 28, and is functionally excellent as the corona discharger for modulation. Each of the corona dischargers described hitherto has been shown to employ well-known corona wires as the discharge electrodes, whereas other forms of electrodes such as needle electrodes or the like are equally applicable.

Figure 12:
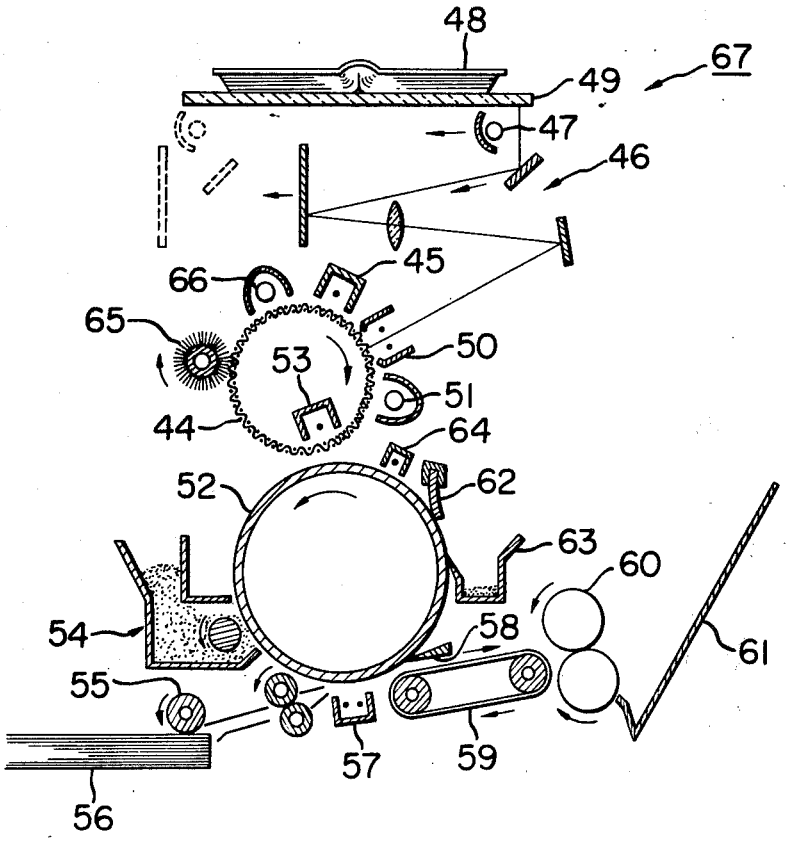
FIG. 12 schematically illustrates the construction of the electrophotographic copying apparatus to which the present invention is applied.

As an application of the above-described electrophotographic method, an electrophotographic copying apparatus 67 will hereinafter be described with reference to FIG. 12. The screen 44 in this apparatus is of the design as shown in FIG. 1, and the latent imge forming process follows the steps described in connection with FIGS. 2 to 5. In FIG. 12, the screen 44 is in the form of metal net of 200 meshes formed by weaving stainless wire of 40-micron diameter on an electrically conductive member which provides the substrate. The net was heated to about 1000° C by a gas burner, whereafter it was passed between a set of rollers heated to 600° C and capable of applying a pressure of 1.0 kg/cm$^2$, whereby the metal strings were heated annd fused without blocking the openings of the net to thereby form an electrically conductive member which could provide an excellent rigid substrate. Thereafter, the stainless net was cut into a desired configuration, and the opposite ends thereof were welded together to form a cylindrical configuration, whereafter an annular back-up member was provided on each of the opposite ends of the cylinder to thereby constitute a prototype of the photosensitive screen. The electrically conductive member is overlaid with a layer of resin-bound CdS particles as photoconductive member, which in turn is covered with an insulative layer formed of resin. The screen 44 is rotated in the direction of arrow by unshown drive source and uniformly charged at 7 KV by a first corona discharger 45, whereafter the image of an original 48 illuminated by a lamp 47 is projected upon the screen 44 through an optical system 46 having mirrors and lens system. Numeral 49 designates a stationary original carriage of transparent glass on which the original 48 is immovably placed. Simultaneously with the projection of the original image, discharge is effected by an AC discharger 40 of 7 KV which is a second discharger, so that a primary electrostatic latent image corresponding to the original image is formed on the screen 44. Later, the screen 44 is uniformly exposed to light from a lamp 51 to form a primary electrostatic latent image thereon. At this point of time, a grounded insulative recording drum 52 disposed with a minimum distance of 2 mm relative to the screen 44 begins to be rotated with the screen 44 at a peripheral speed higher than that during the primary electrostatic latent image formation but in the same direction. The insulative recording drum 52 comprises an aluminum drum coated with a layer of polycarbonate as the insulative layer having a thickness of 15 microns. A corona ion flow of −11 KV from a third corona discharger 53 disposed within the screen 44 is imparted to the drum 52 through the primary electrostatic latent image on the screen 44 which is subjected to a voltage of −4 KV, whereby a secondary electrostatic latent image of about −500 V is formed on the drum 52. A voltage of −7 KV is applied to the shield plate of the corona discharger 53 and the controlled width of corona discharge is such that the distance between the screen 44 and the recording drum 52 is up to 5 mm at the entrance portion and up to 4 mm at the exit portion. Insulative members are provided in the opening portion of the shield plate. Thereafter, the electrostatic latent image on the recording drum 52 is toner-developed by a developing device 54, and then the toner image is transferred to a sheet of transfer paper, supplied by means of a suppply roller 55, by the action of a transfer corona discharger 57 of −6 KV. The transfer paper now bearing the toner image thereon is separated from the drum 52 by a separator pawl 58 and conveyed by a conveyor belt 59, so that it is heat-fixed by a hot-roller fixing device 60 and discharged into a discharge paper tray 61. In the drawing, the numeral 62 designates a cleaning blade disposed in a peripheral portion of the recording drum 52 for removing any excess toner, and 63 a toner collector for the toner removed by the blade 62. The developing device 54 and the toner collector 63 are connected together by conveyor means such as screws (not shown), and the toner in the collector is available for reuse. Designated by 64 is an AC corona discharger for deelectrifying the recording drum 52 after cleaned, and all secondary electrostatic latent image is removed by this discharger 64 so that the recording drum may be ready for another cycle of electrostatic latent image formation. Cleaning means 65 is disposed in a peripheral portion of the screen 44 for removing any dust or the like adhering to the screen 44, and it comprises a brush and suction mechanism. Numeral 66 denotes a lamp for imparting a uniform light to the screen 44.

Any of the embodiments of the present invention has been described with respect to a case where a secondary electrostatic latent image is formed on the recording member in accordance with the primary electrostatic latent image formed on the screen. However, the present invention is also applicable to a method whereby development is effected by electrostatic collection of developer mist during and not after the formation of a secondary electrostatic latent image on a recording member, or to a method whereby a corona ion flow is imparted through a primary electrostatic latent image to a recording member including no conductive layer while, at the same time, development is carried out by imparting conductive developer to tht side of the recording member which is opposite to the side bearing the latent image. Further, the screen is not restricted to the form shown in FIG. 1, and the latent image forming process is neither restricted to the shown one.

According to the present invention, as described above, when a secondary electrostatic latent image is formed on the recording member by modulating a corona ion flow in accordance with the primary electrostatic latent image on the screen, the width of corona discharge from the discharger producing the corona ion flow is limited within a range which allows for the distance between the screen and the recording member from the viewpoint of image formation. By producing uniform and sufficiently intense corona discharge within such limited range, the present invention enables secondary electrostatic latent image of high quality to be formed at high speed.

We claim:

1. In an electrophotographic method in which a photosensitive screen having a multitude of tiny openings is used to form a primary electrostatic latent image thereon and an ion flow from a fixed corona discharger is modulated by the primary electrostatic latent image to form a secondary latent image on a chargeable member, wherein the width of the corona discharge impinging on the surface of the screen defines a modulation width and wherein the distance between a point on the screen and the chargeable member varies as the point is moved through the modulation width, comprising the steps of moving the screen past the fixed corona discharger so that a point on the screen moves from one end of the modulation width to the other end thereof and simultaneously moving the chargeable member relative to the fixed corona discharger, the improvement comprising the step of:

establishing an acceleration field having a voltage Ve between the screen and the chargeable member which satisfies the relation $Ve/d > 500$ (V/mm) at the one end of the modulation width, where *d* is the distance between the screen and the chargeable member and which also satisfies the relation $(Ve-Vs)/d > 500$ (V/mm) at the other end of the modulation width, where Vs is the maximum potential of the secondary electrostatic latent image formed on said chargeable member.

2. A method according to claim 1, wherein said screen is formed in the shape of a drum, and wherein the movement of the screen is produced by rotating the drum-shaped screen.

3. A method according to claim 2, wherein said fixed corona discharger comprises a discharge electrode and a shield plate provided therearound, and wherein a bias voltage is applied to the shield plate in order to limit the effective width of the corona ion flow in order to satisfy said relations.

4. A method according to claim 3, wherein the effective width of the corona ion flow is limited by positioning the shield plate adjacent the discharger and by applying a voltage to the shield plate of the opposite polarity to that of the voltage applied to the corona discharge electrode.

5. A method according to claim 3, wherein the effective width of the corona ion flow is limited by positioning the shield plate adjacent the discharger and by applying a voltage to the shield plate of the same polarity as that of the voltage applied to the corona discharge electrode.

6. A method according to claim 3, wherein the effective width of the corona ion flow is limited by use of a varistor element.

7. A method according to claim 6, wherein the shield plate of the corona discharger is provided with a separate member connected to the varistor element.

8. A method according to claim 2, wherein said fixed corona discharger comprises a discharge electrode and a shield plate provided therearound, and wherein a limiting member is mounted to the shield plate in order to limit the effective width of the corona ion flow in order to satisfy said relations.

9. A method according to claim 8, wherein the effective width of the corona ion flow is limited by positioning the shield plate adjacent to the discharger and by mounting an insulative member along the opening of said shield plate.

10. A method according to claim 2, wherein said corona discharger is asymmetrically disposed with respect to a plane defined by the central axis of said drum-shaped screen and the closest line to said central axis on the surface of the chargeable member with the corona discharger off-set in a direction opposite to the direction of movement of the screen.

11. A method according to claim 1, wherein the chargeable member is formed in the shape of a drum, and wherein the moving of the chargeable member is produced by rotating the drumshaped chargeable member.

12. A method according to claim 1, wherein the screen and the chargeable member are each formed in the shape of drum, and are rotatable with their surfaces adjacent to each other during the movement of the screen through the modulation width.

13. A method according to claim 1, wherein modulation of corona ion flow is carried out a plurality of times from a single primary electrostatic latent image to form a plurality of secondary electrostatic latent images.

14. In an electrophotographic method in which a photosensitive screen having a multitude of tiny openings is used to form a primary electrostatic latent image thereon and an ion flow from a fixed corona discharger is modulated by the primary electrostatic latent image to form a secondary latent image on a chargeable member, wherein the photosensitive screen is in the form of a drum and comprises an electrically conductive base member having a multitude of tiny openings, a photoconductive member formed on said base member and an insulative member formed on the photoconductive member on the outside of the drum-shaped screen, wherein the width of the corona discharge impinging on the surface of the screen defines a modulation width and wherein the distance between a point on the screen and the chargeable member varies as the point is moved through the modulation width, comprising the steps of moving the screen past the fixed corona discharger so that a point on the screen moves from one end of the modulation width to the other end thereof and simultaneously moving the chargeable member relative to the fixed corona discharger, the improvement comprising the step of:

establishing an acceleration field having a voltage Ve between the screen and the chargeable member which satisfies the relation $Ve/d > 500$ (V/mm) at the one end of the modulation width, where $d$ is the distance between the screen and the chargeable member and which also satisfies the relation $(Ve-Vs)/d > 500$ (V/mm) at the other end of the modulation width, where Vs is the maximum potential of the secondary electrostatic latent image formed on said chargeable member.

* * * * *

UNITED STATES PATENT OFFICE

CERTIFICATE OF CORRECTION

Patent No. 4,143,965 Dated March 13, 1979

Inventor(s) YUJIRO ANDO, ET AL

It is certified that error appears in the above-identified patent and that said Letters Patent are hereby corrected as shown below:

Column 4, line 3, change "and" to --to--;

Column 8, line 5, change "V3-Vs" to --Ve-Vs--;

Column 8, line 10, change "(Ve-(Ve-" to --(Ve-Vs)/d--;

Column 8, line 56, change "copy" to --copying--;

Column 9, line 62, change "annd" to --and--;

Column 9, line 67, change "by" to --of--;

Column 10, line 30, change "breakdowen" to --breakdown--;

Column 10, line 55, change "annd" to --and--;

Column 12, line 7, change "tht" to --that--;

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*